US008650923B2

(12) United States Patent
Ingvarsson

(10) Patent No.: US 8,650,923 B2
(45) Date of Patent: Feb. 18, 2014

(54) PRODUCTION LINE AND A METHOD OF SHAPING PROFILES

(75) Inventor: Lars Ingvarsson, Borlange (SE)

(73) Assignee: Ortic 3D AB, Borlange (SE)

( * ) Notice: Subject to any disclaimer, the term of this patent is extended or adjusted under 35 U.S.C. 154(b) by 1430 days.

(21) Appl. No.: 11/918,705

(22) PCT Filed: Apr. 24, 2006

(86) PCT No.: PCT/SE2006/000456

§ 371 (c)(1),
(2), (4) Date: Oct. 17, 2007

(87) PCT Pub. No.: WO2006/115447

PCT Pub. Date: Nov. 2, 2006

(65) Prior Publication Data

US 2009/0025446 A1 Jan. 29, 2009

(30) Foreign Application Priority Data

Apr. 28, 2005 (SE) ..... 0500954

(51) Int. Cl.
*B21B 15/00* (2006.01)
*B21D 5/08* (2006.01)

(52) U.S. Cl.
USPC ..... 72/177; 72/181

(58) Field of Classification Search
USPC ..... 72/176–178, 181, 182
See application file for complete search history.

(56) References Cited

U.S. PATENT DOCUMENTS

| | | | | |
|---|---|---|---|---|
| 4,354,372 | A | 10/1982 | Inoue et al. | |
| 4,418,558 | A * | 12/1983 | Simmons | 72/177 |
| 5,253,501 | A * | 10/1993 | Spath | 72/177 |
| 2003/0038489 | A1 | 2/2003 | Renzzulla et al. | |
| 2004/0040357 | A1 | 3/2004 | Ingvarsson et al. | |

FOREIGN PATENT DOCUMENTS

| | | |
|---|---|---|
| AU | 859441 | 5/2001 |
| JP | 04-127924 | 4/1992 |
| JP | 06-328145 | 11/1994 |
| JP | 08-072044 | 3/1996 |
| JP | 11-047836 | 2/1999 |
| WO | WO 03/041886 | 5/2003 |
| WO | WO 2005/082559 | 9/2005 |

* cited by examiner

*Primary Examiner* — Teresa M Ekiert
(74) *Attorney, Agent, or Firm* — Mark P. Stone

(57) ABSTRACT

Profiles (50) are formed in a production line with a cross-section that varies along their length from a plane metal strip (10) that is unwound from a tape reel (9). Edge cutters (14) and roll-forming units (17-24) are displaceable individually sideways relative to the strip, and are individually controlled. The formed profile is curved in a curving station integrated into the production line and having roller pairs (82, 84; 83, 85) that can be controlled to roll sides of the profile (50) such that they become thinner so that the profile is curved or twisted as it is formed. The roller pairs and the sideways displacement and the angular motion of the roll-forming units are controlled so that the roller pairs follow the sides and such that a line (II) between the axles of one roller pair is held perpendicular to the surface being rolled.

9 Claims, 9 Drawing Sheets

Fig 7
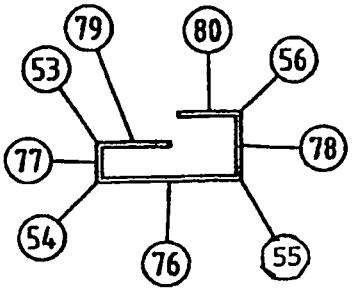
Fig 6
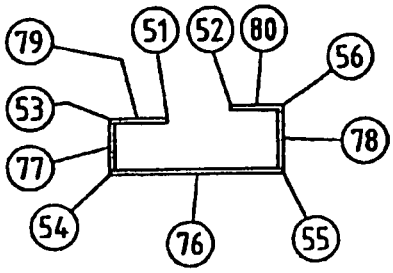
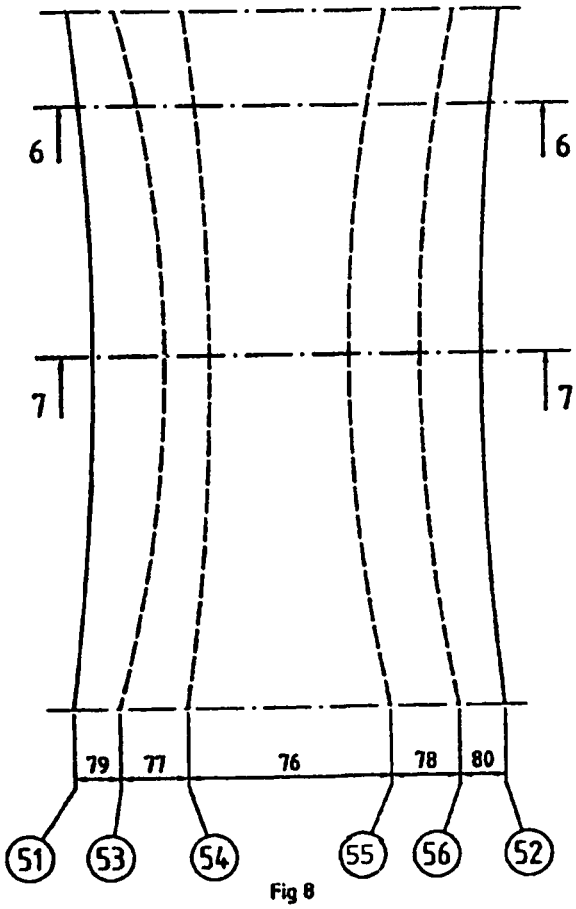
Fig 8

Fig 13
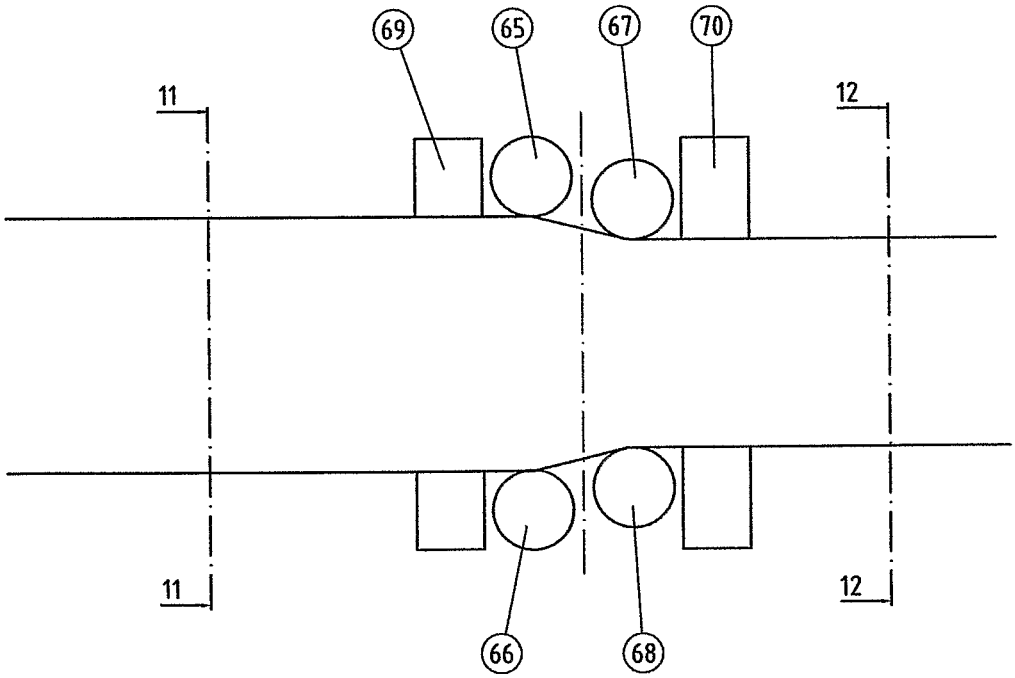
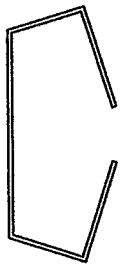
Fig 11
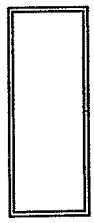
Fig 12

PRODUCTION LINE AND A METHOD OF SHAPING PROFILES

TECHNICAL AREA

The present invention relates to a method to form from a plane strip of metal and curve a profile that has a variable profile along its length. The invention relates also to a production line for the continuous forming of profiles that have a variable cross-section along their lengths from a plane metal strip that is uncoiled from a tape reel, comprising an unwinder, a roller leveller, a stamp for the transverse cutting of the strip and edge cutters for edge cutting of the strip, followed by a roll-forming section with a number of roll-forming units, wherein the edge-cutters and the roll-forming units can be individually displaced and guided in a transverse direction in order to vary continuously the final appearance of the profile that is being produced.

THE PRIOR ART

WO 02/43886 A1 describes a roll-forming machine that is used in this way to fold up and form the edges of a roofing sheet of the type known as "standing seam". The width of the roofing sheet can be varied along the length of the sheet and the vertical edges have the same form along the complete length.

AIM OF THE INVENTION

It is one aim of the invention to provide economic manufacture of curved sheet metal profiles with profiles that vary along the length of the profile and that have high precision in the curvature, with low inherent stress.

This is primarily achieved according to the method of the invention by cutting the edge of the strip to a preformed sheet blank, folding up sides on the blank in a number of roll-forming units that can be individually displaced in a transverse direction and rotated, and rolling in a roller pair the sides of the profile formed to become thinner on one side such that the profile becomes curved, whereby the roller-pair is controlled by the same computer program as that used to control the transverse displacements of the roll-forming unit and its angular motions, such that the roller-pair follows the sides and such that a line between their axes is maintained always perpendicular to the surface that is being rolled.

A production line according to the invention comprises a curving station after the roll-forming line and this curving station comprises a roller pair that can be controlled to follow the sides of the profile and to roll parts of the sides of the profile more thinly such that the profile becomes curved or twisted as it is formed, whereby the roller-pair is supported by supports that can be rotated in order to allow twisting of the roller-pair such that a line between the axes of the rollers in one pair can be held during rolling always perpendicular to the side being rolled.

The invention is defined by the attached patent claims.

BRIEF DESCRIPTION OF THE DRAWINGS, WHICH SHOW EQUIPMENT ACCORDING TO THE INVENTION BY WHICH THE METHOD ACCORDING TO THE INVENTION CAN BE CARRIED OUT

Figure 2:
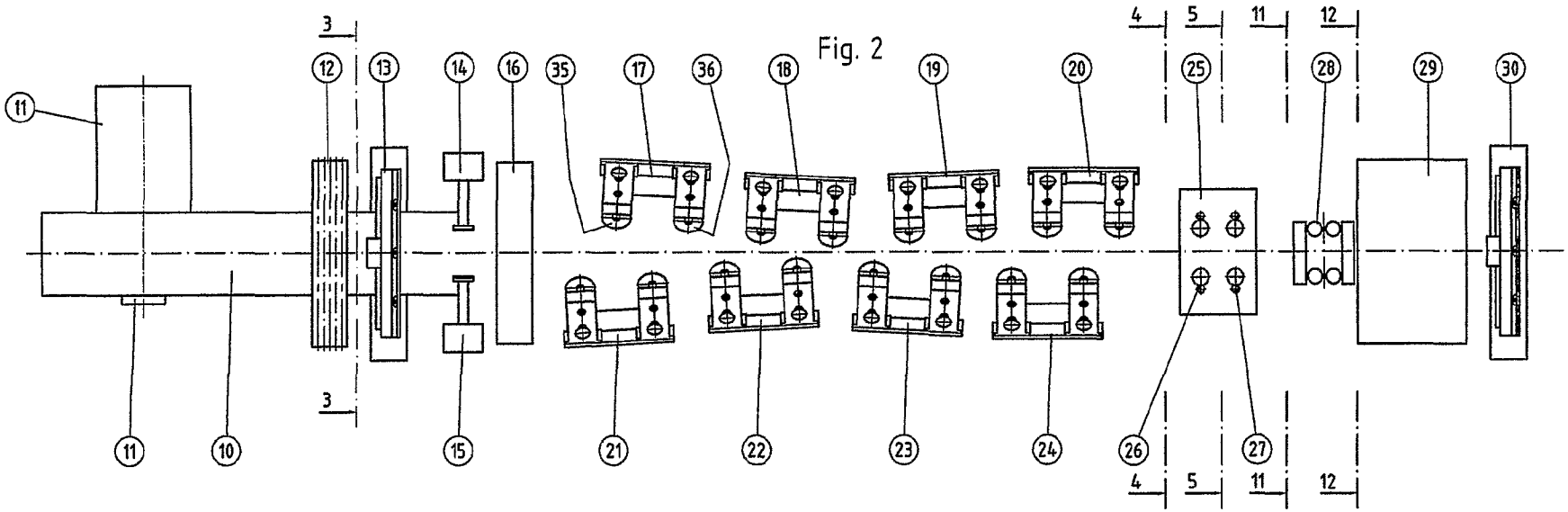
FIG. 2 illustrates a view from above of the line in FIG. 1.
Figure 9:
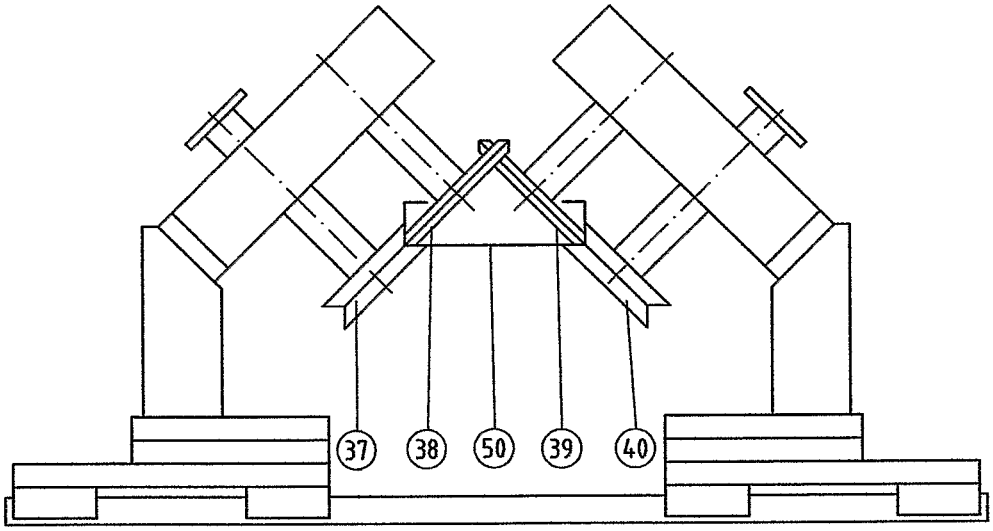
Figure 10:
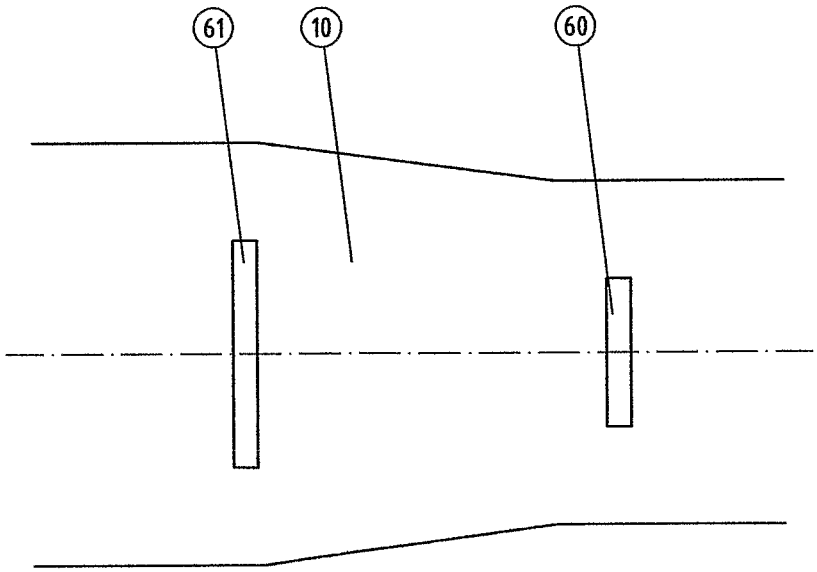

FIGS. 6 and 7 show cross-sections of a strip formed in the equipment that is shown in the preceding figures, where the cross-section corners follow the lines 6-6 and 7-7 in FIG. 8;

FIG. 8 shows the formed strip shown in FIGS. 6 and 7;

FIG. 9 shows the final roll-forming step of the production line in the forming of a C-profile;

FIG. 10 shows a part of an edge-cut and punched strip before profiling;

FIGS. 11 and 12 show sections taken before and after a tube-forming unit as is specified by the lines 11-11 and 12-12 in FIG. 13 and in FIG. 2;

FIG. 13 shows enlarged and schematically a tube-forming unit seen from above.

Figure 4:
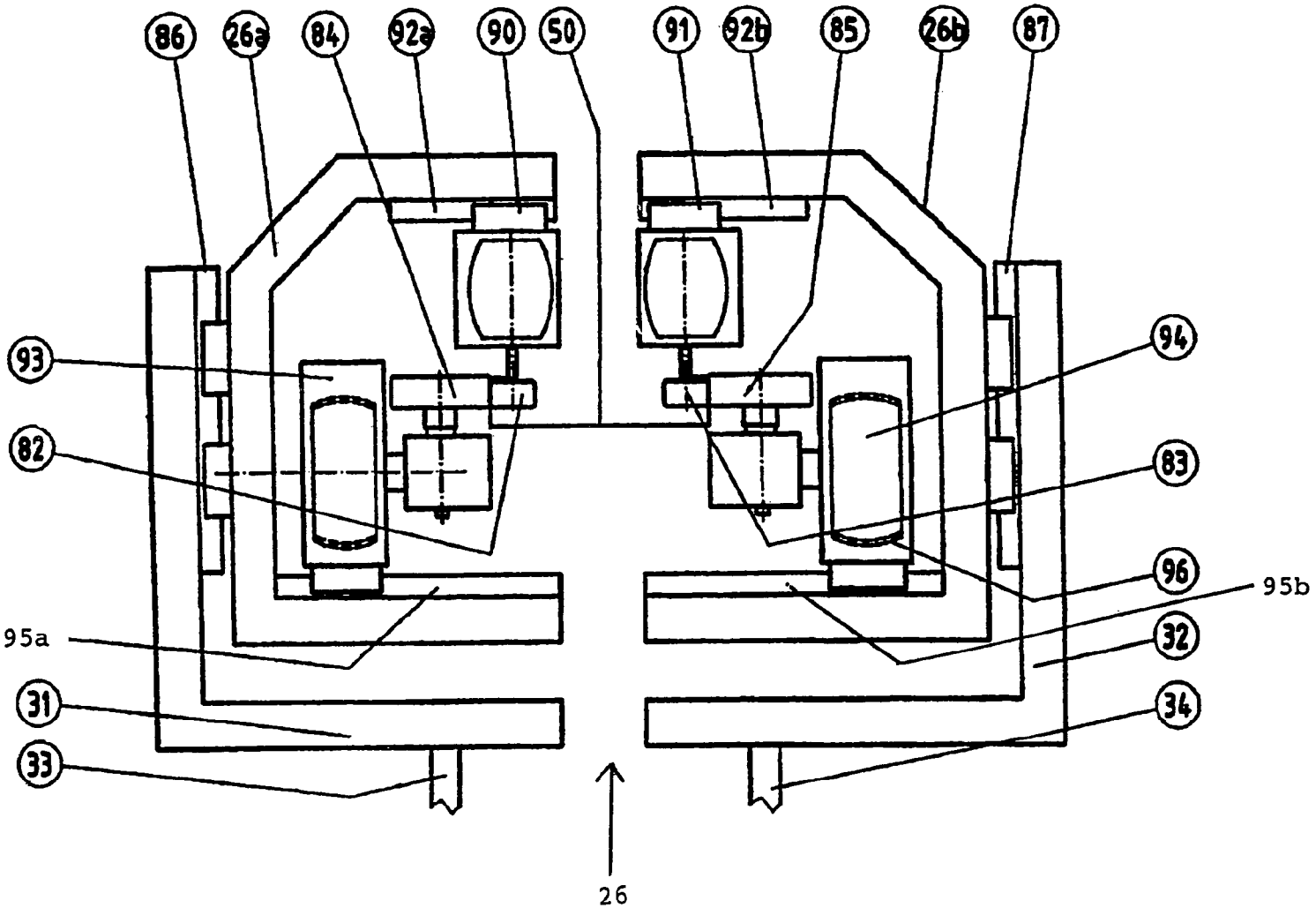
FIG. 4 is a sectional view along the line 4-4 in FIG. 2, showing enlarged and schematically a first curving unit for curving of the profile formed.
Figure 14:
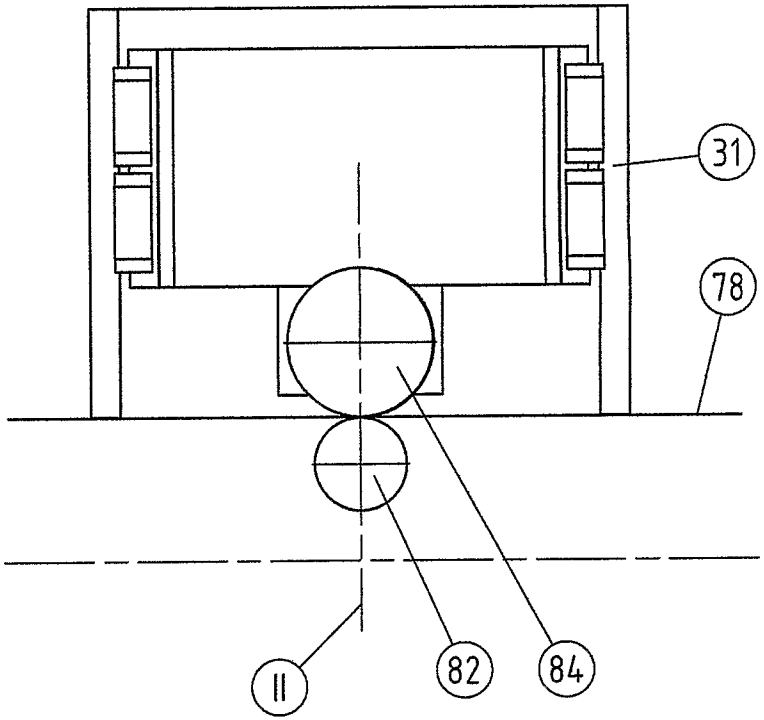

FIG. 14 shows schematically a part of FIG. 4 seen from above during the rolling of a straight profile flange.

Figure 15:
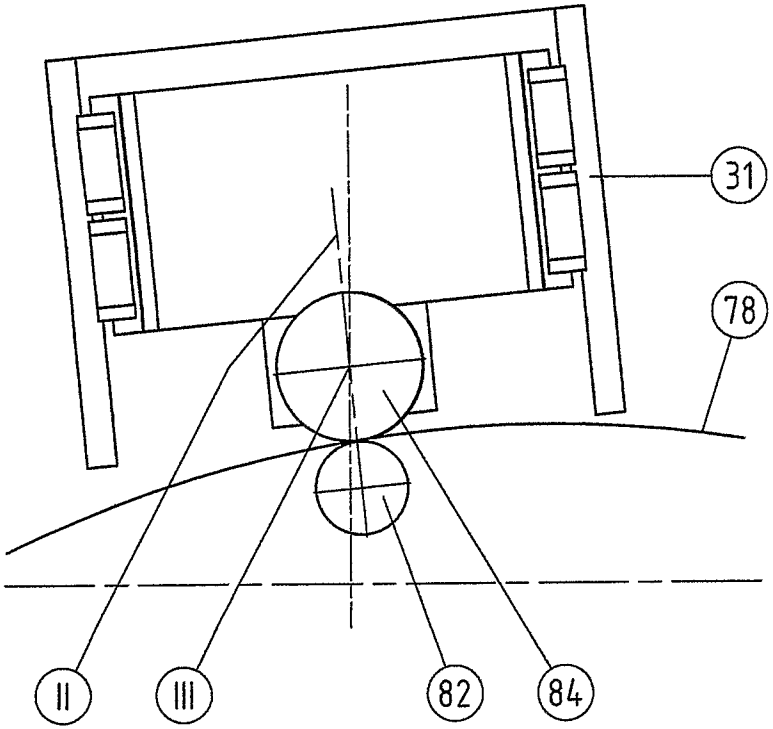

FIG. 15 corresponds to FIG. 14, but shows the rolling of a curved profile flange.

DESCRIPTION OF ILLUSTRATED AND PREFERRED EMBODIMENTS

Figure 1:
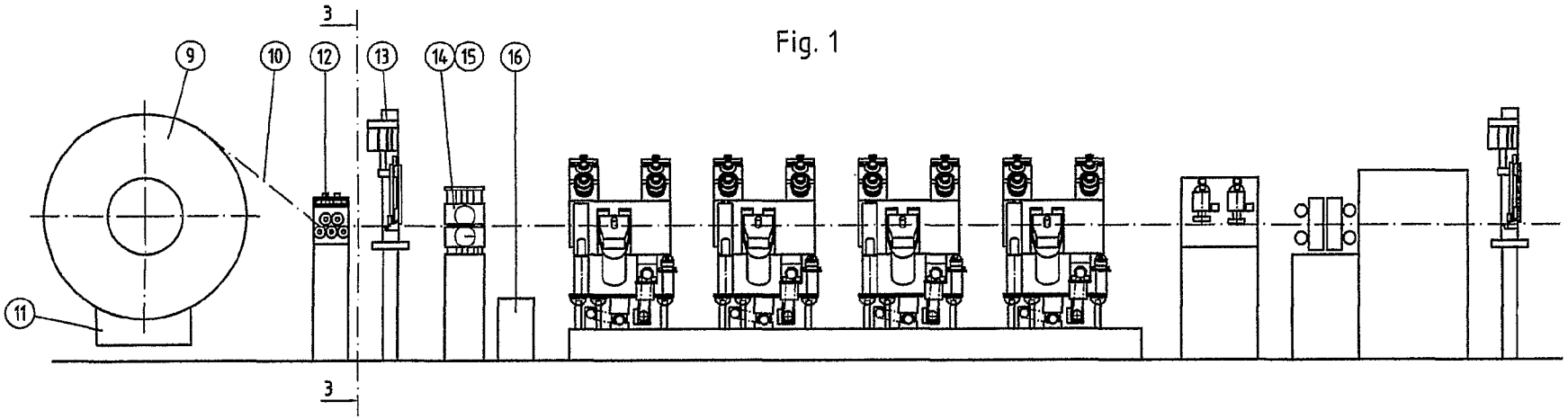
FIG. 1 illustrates a production line schematically in a side view.

FIGS. 1 and 2 show schematically a production line that contains an unwinder 11 for unwinding a metal strip 10 from a tape reel 9, a roller leveller 12 for levelling the metal strip 10, an initial stamp 13, an edge cutter station 14, 15 on each side of the strip 10, a waste mill 16 for collecting the edges of the strip that have been removed, four roll-forming units 17-20 and 21-24 on each side of the strip 10 for folding the strip into a profile, a curving station 25 that contains two curving units 26, 27 for curving the formed profile, a tube-forming unit 28 for closing the formed profile, a welding unit 29 for welding the seam of the closed profile, and a terminal cutter 30 for the final cutting of the completed profile.

Figure 3:
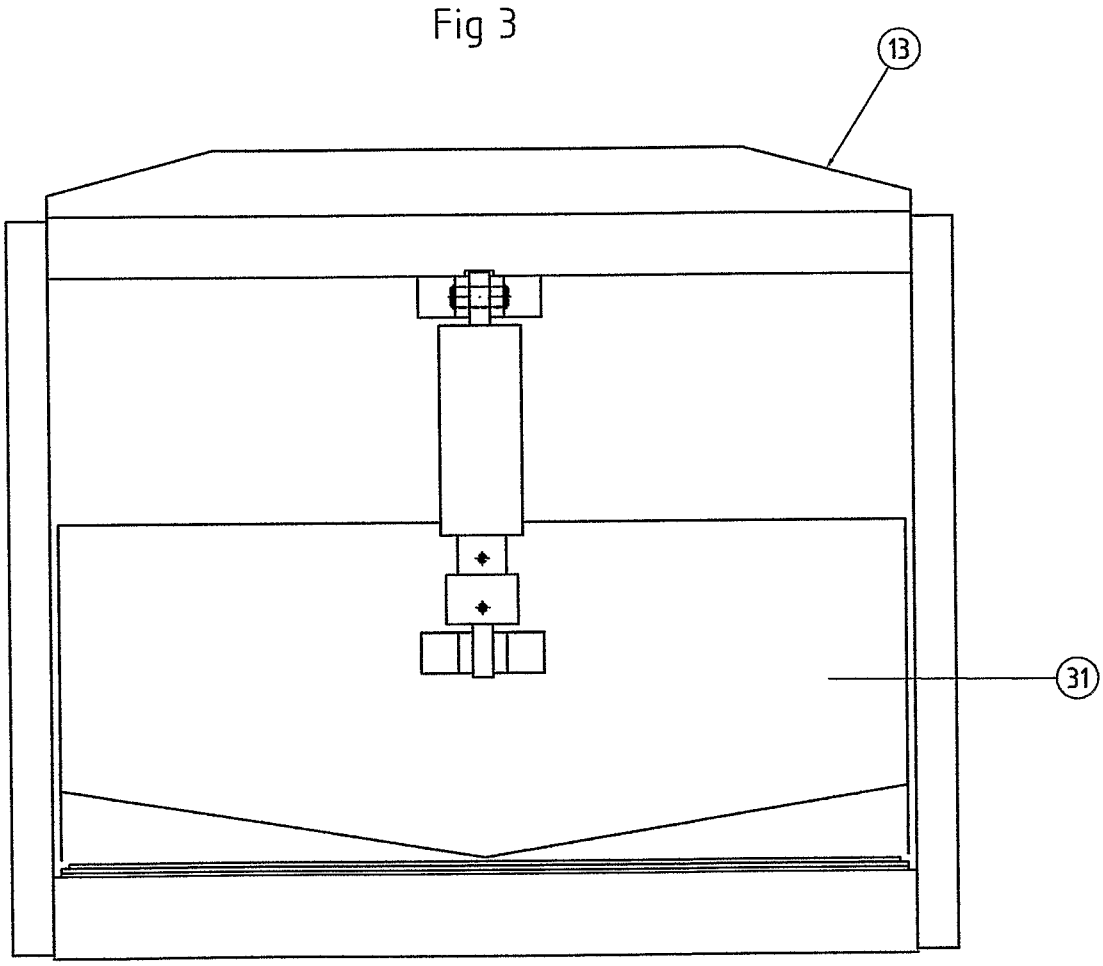
FIG. 3 is a sectional view along the line 3-3 in FIG. 2, showing enlarged and schematically a punch.

FIG. 3 shows enlarged the initial stamp 13, which has an angle cutter 31 such that it begins the stamping in the centre of the strip and such that the stroke length determines the length of the slit.

The edge cutter stations 14, 15 can be individually displaced in a sideways direction, that is, transverse to the direction of the strip. The roll-forming units 17-24 are all identically constructed and they can all be individually displaced. They have a carrier that supports, as is shown on the roll-forming unit 17, two pairs of rollers 35, 36 in tandem, and they can be displaced in a sideways direction and rotated around a vertical axis. FIG. 9 shows the final roll-forming step on each side of the strip in order to give the final C-profile 50 with two pairs of forming rollers 37, 38; 39, 40.

FIGS. 6 and 7 show two cross-sections of a completed C-profile 50 that has an asymmetric cross-section and a cross-section that varies along its length. The edges of the profile have been given the reference numbers 51, 52, and its corners have been given reference numbers 53-56. A part of the strip before being folded to a profile is shown as FIG. 8. The features that will subsequently become corners are shown in FIG. 8 with dashed lines before the forming to the cross-sections shown in FIGS. 6 and 7. The C-profile can be defined as having a central flange 76 between the corners 54, 55; two upright sides 77, 78 (which may also be defined as walls or sides) between the corners 53, 54 and 55, 56; and two inwardly directed side-flanges 79, 80 between the corners 53, 56 and the edges 51, 52.

The manufacture of a C-profile with a varying cross-section will now be described.

The roller leveller 12 levels the strip that is uncoiled from the tape reel 9 and feeds the tape forwards through the line. Feeding is stopped when the metal that is to be the end of a profile length reaches the initial stamp 13 and a transverse slit is punched out. If the trailing end of one length of sheet and the leading end of the next length of sheet do not have the same extent, with the leading end being, for example, broader than the trailing end of the previous sheet, as is shown in FIG. 10, a slit 60 is first made for the trailing end and a slit 61 is subsequently made for the leading end once the strip has been fed forwards through a certain distance. The length that lies between will become a waste piece when the lengths are finally separated as will be described later. FIG. 10 shows the strip as it appears after it has been punched and after the edges have been cut. The lengths of the slits are adapted such that the corners 53, 56 of the final profile are removed by stamping and only the plane parts between the corners 53, 56 and the ends 51, 52 remain for the final profile. The slits are made sufficiently wide such that it will be possible later to cut away the final profile using tools that enter through the slits from underneath.

The cutting of the edge can be carried out after the punching as is shown, or it can be carried out before the punching. If the edges of the completed profile are to be outwardly folded, it is not necessary to cut the edges before the shaping. It is possible in this case to cut the edges after the roll-forming but before the curving operation. It is, however, advantageous to cut the edges before the roll-forming as shown, particularly since a machine such as the one shown can be used for general applications.

The first two roll-forming units 17, 18 and 21, 22 on each side of the strip are controlled such that their forming rollers follow the outermost corners 53, 56, that is, they follow the lines 53,56 shown in FIG. 8. There are two steps with pairs of forming rollers in tandem in each roll-forming unit, and thus each roller pair will not follow exactly their line in FIG. 8, nor will it be twisted exactly in line therewith. However, the lines have gradual curves, and this means that the error will be so small that it does not have any practical significance. It is also often possible to have three roll-forming steps at each roll-forming unit 17-24. It is also possible, if required, to have several roll-forming units in the line such that it is possible to use several roll-forming steps for each corner and to be able to roll-form more corners than the four corners that are shown. The term "corner" is used to denote not only sharp corners such as those shown but also corners in the form of curves. Nor is it necessary that the roll-forming is carried out in a symmetrical manner on the two sides of the strip as shown.

When a point on the strip passes the roll-forming units 18 and 22, the corners 53 and 56 are fully formed and the roll-forming of the corners 54, 55 then commences. When the strip has passed the final roll-forming step, the strip has achieved its final form and in this case, when the profile is an open C-profile, it passes the curving station 25, the tube-forming unit 28 and the welding unit 29, without being processed or formed. When the first slit 60 reaches the terminal cutter 30 feeding of the strip is halted and the cutter passes up through the slit and completely cuts off the profile. The strip is then fed forwards and stopped when the slit 61 reaches the terminal cutter 30. The profile is then cut at this location and the intermediate section of profile becomes waste. It is possible to cut off the strip fully before the roll-forming, as an alternative to the procedure with a complete strip, but the procedure with the strip that is held together is preferred. It is also possible, naturally, to form other profiles than C-profiles, such as, for example, hat-profiles. If more roll-forming units than those shown are used, it is possible to form profiles with more corners than those shown. It is possible to determine for each profile how many roll-forming units are to be used for each corner, since the roll-forming units can be individually controlled.

When a closed C-profile is to be formed, it is not possible to roll-form it to its final form since it is necessary to introduce form-rollers into the profile in the manner that is shown in FIG. 9. The roll-forming therefore ends with a profile such as that shown in FIG. 11 and in the roll-forming unit 28, which in one or several steps presses the profile together with vertical rollers 65-68 and provides support at the bottom with horizontal rollers 69, 70 as is shown both in FIGS. 1 and 2 and, enlarged, in FIG. 13. The profile thus obtains the closed form that is shown in FIG. 12 and it is then directly seam-welded in the welding unit 29, which is located in the direct vicinity such that the profile cannot spring open.

Figure 5:
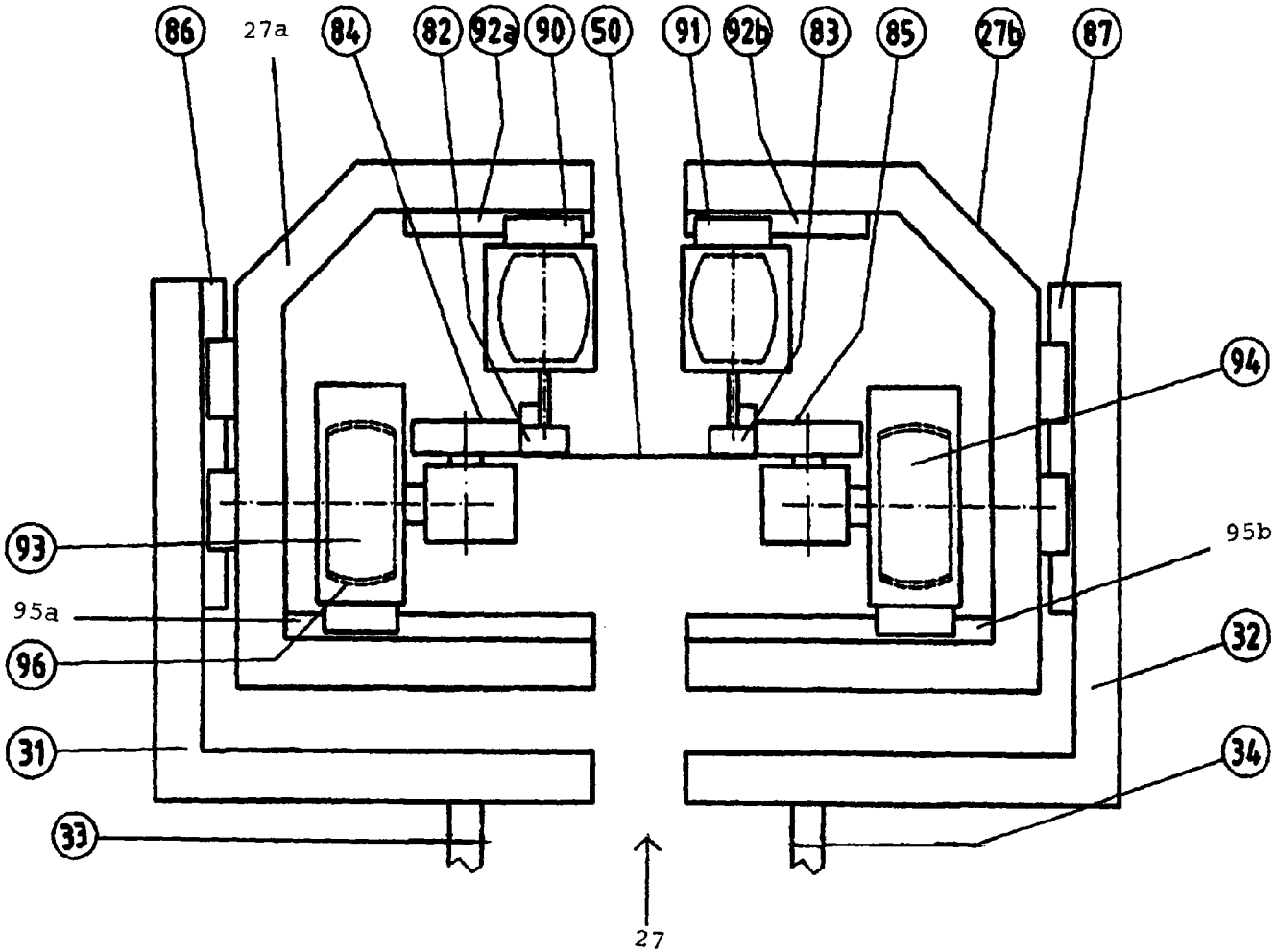
FIG. 5 is a sectional view along the line 5-5 in FIG. 2, showing enlarged and schematically a second curving unit for curving of the profile formed.

FIGS. 4 and 5 show the two curving units 26, 27 that are used when it is desired to curve or twist the profile. The profile 50 is given the same reference numbers as in FIG. 6, although not all numbers are present in FIG. 4.

The curving unit 26 shown as FIG. 4 will be described in more detail. It consists of two separate frames 26A and 26B, each of which supports a roller pair 82, 84 and 83, 85. Each roller pair has its counter roller 82, 83 inside of the profile 50, and these counter rollers can be adjusted such that they make contact with the upper part of the side of the profile 50 that stands vertically. Rollers 84, 85 make contact on the outer surface of the wall or side. The curving unit 26 thus has one roller pair 82, 84 for one side of the profile 50, and one roller pair 83, 85 for the second side of the profile. These roller pairs are supported such that they can be independently displaced in a manner that will be described.

The frames 26A and 26B are supported by support frames 31, 32 that can be rotated to a limited extent by means of supporting axles 33, 34 supported by the frame of the machine. The frames 26A and 26B can be displaced vertically along the rails 86, 87 in the support frames 31, 32. The counter rollers are supported by units 90, 91 that can be slid in a sideways direction along the rails 92A and 92B and the rollers 84, 85 are supported by units 93, 94 that can be displaced by sliding along the rails 95A and 95B. The counter rollers and the rollers 82-85 can be adapted to the profile in that the angles at which they are positioned can be adjusted to a limited extent within the relevant unit 90, 91, 93, 94 along the partial surfaces of a circle as has been suggested with dashed lines 96, and they can be adjusted such that the gap between them is to become more narrow in order to provide a continuous thinning of the rolled metal in one direction. The various power units for carrying out the adjustment and for supplying force are not shown in the drawing. These may, for example, be hydraulic units.

The profile will be curved downwards when the rollers are pressed with a large force and with some obliqueness against the vertical sides or walls of the profile in order gradually to thin the vertical sides upwards. The rollers are supplemented with support and guide rollers located after the rollers, in order to give the profile an exact form in all three dimensions. These support and guide rollers are not shown in the figures.

The unit 27 shown in FIG. 5 consists of two separate frames 27A and 27B, and has a similar structure to that of the unit 26 that has been described above and is shown in FIG. 4. The unit shown in FIG. 5 will, therefore, not be described in detail.

Equivalent items have the same reference numbers as they have in FIG. 4. The rollers 84, 85 are arranged to roll the vertical sides of the profile gradually thinner against this central flange of the profile 50, such that the profile curves upwards.

In order to curve the profile in a sideways direction, the rollers of both units are used on the same side, such that the complete vertical side of one side of the profile is thinned and curves the profile in the opposite direction. In order to twist the profile, the roller of the unit 26 is used on one vertical side of the profile, while the roller of the unit 27 is used on the second vertical side of the profile.

FIGS. 14 and 15 show, seen from above, one side 78 of the profile 50 in FIGS. 6 and 7 during the rolling operation with one of the pairs of curving rollers, the pair 82, 84. The side 78 in FIG. 14 is parallel with the machine, while that in FIG. 15 is shown to be curved. The support frame 31, i.e. the supporter of the roller pair 82, 84, is turned around its support axle 33, i.e. around the axis III, which is shown to go through the centre of the roller 84, such that a line II between the axes of the roller pair 82, 84 will be always perpendicular to the side 78. The turning of the support frame 31 corresponds to that of the roll-forming units.

Thus, it is possible to curve the profile in a freely chosen direction by controlling the rolling forces of the rollers 84, 85, and it is also possible to twist the profile in the desired direction. It is also possible to control all four rollers at the same time, such that the profile is both curved and twisted at the same time.

It should be possible to displace the units that are located after the curving unit, i.e. the tube-forming unit 28, the welding unit 29 and the terminal cutter 30, both in a vertical and in a horizontal direction, and it should be possible to turn these units, if it is desired to use them for curved and twisted profiles.

Not all of the means available on the machine for twisting, displacing, etc., are shown on the drawings. All of these means are controlled by a programmable computer system such that they work simultaneously in order to give the desired result. The roll-forming units 17, 18 or 21, 22 of one side and the curving rollers 82, 84 or 83, 85 of the same side are controlled by the same computer program such that the roll-forming units, for folding up the sides of the profile 50 and forming the corners 54, 58, and the roller pairs, for rolling these sides, will move in a similar fashion both with respect to their sideways displacement and with respect to their angular turning during the manufacture of the profile 50 and during its curving. It is also appropriate that the motion of the parts 26A and 26B of the curving unit along the rails 86, 87 is controlled by computer. This motion is not necessary if the sides of the profile have a constant height.

An integrated machine for the roll-forming of a profile and its curving has been shown above, and this is often preferred. It is, however, possible, to have one machine for roll-forming and one machine for curving, and also in this case to use the same program for controlling the roll-forming units in order to fold up the sides and to control the curving rollers in order to follow the sides in the manner that has been described.

The invention claimed is:

1. A method for forming from a plane strip of metal (50) and for either curving or twisting, or both, a profile (50) with a cross-section that varies along its length, characterised in that sides (77, 78) are folded up on the metal strip in a number of roll-forming units (17, 18; 21, 22) to form the profile, wherein the roll-forming units are displaceable sideways and rotated independently of each other, and the sides of the profile formed are rolled vertically in roller pairs (82, 84; 83, 85) to become thinner at one of their edges such that the profile is curved or twisted, and in that the roller pairs for thinning the sides of the profile and the sideways displacement and angular motion of the roll-forming units are controlled by the same computer program such that the roller pairs follow the sides vertically and a line (II) between the axles of the rollers in one roller pair is always maintained perpendicular to the side being rolled.

2. The method according to claim 1, characterised in that a rolling gap in the roller pairs (82, 84; 83, 85) is varied during feed of the profile (50) through the roller pairs, and in this way the curvature of the profile along its length is varied.

3. The method according to claim 2, characterised in that a first transverse slit (60) is cut in the strip (10) in the line before the roll-forming operation, without fully cutting off the strip, and in that a terminal cutter (30) cuts off the strip after the roll-forming operation in order to cut off the trailing end of a profile length manufactured from the strip.

4. The method according to claim 3, characterised in that lengths of profile are manufactured that have different widths of extent at their two ends, and the width of the strip is adjusted between said first transverse slit (60) that defines the trailing end of one length of profile and a further slit (61) that is cut in order to define the leading end of the subsequent length of profile, and then the strip is cut at both slits in the subsequent terminal cutter (30).

5. The method according to claim 2, characterised in that the roll-forming and the curving are carried out in one unified production line, in which the metal strip is unwound from a tape reel (9) and the edges are cut to a form suitable for the final product before the strip, the edges of which have been cut, is roll-formed.

6. The method according to claim 5, characterised in that a first transverse slit (60) is cut in the strip (10) in the line before the roll-forming operation, without fully cutting off the strip, and in that a terminal cutter (30) cuts off the strip after the roll-forming operation in order to cut off the trailing end of a profile length manufactured from the strip.

7. The method according to claim 1, characterised in that the roll-forming and the curving are carried out in one unified production line, in which the metal strip is unwound from a tape reel (9) and the edges are cut to a form suitable for the final product before the strip, the edges of which have been cut, is roll-formed.

8. The method according to claim 7, characterised in that a first transverse slit (60) is cut in the strip (10) in the line before the roll-forming operation, without fully cutting off the strip, and in that a terminal cutter (30) cuts off the strip after the roll-forming operation in order to cut off the trailing end of a profile length manufactured from the strip.

9. The method according to claim 8, characterised in that lengths of profile are manufactured that have different widths of extent at their two ends, and the width of the strip is adjusted between said first transverse slit (60) that defines the trailing end of one length of profile and a further slit (61) that is cut in order to define the leading end of the subsequent length of profile, and then the strip is cut at both slits in the subsequent terminal cutter (30).

* * * * *